US009974367B2

(12) United States Patent
Liu

(10) Patent No.: US 9,974,367 B2
(45) Date of Patent: May 22, 2018

(54) BASE STRUCTURE FOR WALKING STICK

(71) Applicant: Shih-Chieh Liu, Changhua (TW)

(72) Inventor: Shih-Chieh Liu, Changhua (TW)

(73) Assignee: Homecare Enterprise Co. Ltd., Changhua (TW)

( * ) Notice: Subject to any disclaimer, the term of this patent is extended or adjusted under 35 U.S.C. 154(b) by 70 days.

(21) Appl. No.: 15/004,159

(22) Filed: Jan. 22, 2016

(65) Prior Publication Data

US 2017/0208910 A1 Jul. 27, 2017

(51) Int. Cl.
*A45B 9/04* (2006.01)
*A61H 3/02* (2006.01)

(52) U.S. Cl.
CPC ..... *A45B 9/04* (2013.01); *A61H 3/0277* (2013.01); *A61H 3/0288* (2013.01); *A61H 2003/0283* (2013.01)

(58) Field of Classification Search
CPC ..... A45B 9/04; A61H 3/0288; A61H 3/0277; A61H 2003/0283; A63B 2071/0063
USPC ..... 135/77, 82, 84
See application file for complete search history.

(56) References Cited

U.S. PATENT DOCUMENTS 710,074 A * 9/1902 Pratt ..... A61H 3/0288 135/84
2,453,742 A * 11/1948 Bowen ..... A61H 3/0288 135/77
8,176,927 B2 * 5/2012 Wu ..... A61H 3/02 135/65
9,226,556 B1 * 1/2016 Chien ..... A61H 3/0288
9,386,830 B2 * 7/2016 Crowhurst ..... A45B 9/00
9,681,714 B1 * 6/2017 Yeh ..... A45B 9/04
9,737,121 B2 * 8/2017 Chen ..... A45B 9/04
2006/0219280 A1 * 10/2006 Robinson ..... A61H 3/0288 135/84
2010/0313925 A1 * 12/2010 Jiang ..... A45B 9/04 135/82
2017/0156459 A1 * 6/2017 Chen ..... A45B 9/04

FOREIGN PATENT DOCUMENTS

DE 202014104052 U1 * 9/2014 ..... A61H 3/0277

* cited by examiner

*Primary Examiner* — David R Dunn
*Assistant Examiner* — Danielle Jackson
(74) *Attorney, Agent, or Firm* — Che-Yang Chen; Law Offices of Scott Warmuth

(57) ABSTRACT

A base for a walking stick, which is configured to dispose in a bottom end of a stick body of the walking stick to provide a buffering and shock-absorbing effect, may include a main body, a shaft, a first sleeve, and a second sleeve. An upper portion and a lower portion of the shaft respectively have a first connecting portion and a second connecting portion. Also, a buffering unit disposed on the first connecting portion can allow the second sleeve to be compressed and stretched. Thus, the walking stick can achieve the stretch motion stably, and buffer the reactive force from the floor. Thus, the base structure for a walking stick can allow the stick body to swing in all direction. Also, it can be used to stand on different tilted grounds, and improve the reliability and safety of the walking stick.

7 Claims, 10 Drawing Sheets

BASE STRUCTURE FOR WALKING STICK

FIELD OF THE INVENTION

The present invention relates to a base structure, and more particularly to a base structure for a walking stick.

BACKGROUND OF THE INVENTION

A walking stick is an important tool for individuals, who are elderly or disabled, to move from place to place, and is also used to help stabilize a user when walking, hiking and climbing to reduce the burden of legs.

Generally, the conventional walking stick can be divided into two main types, the handheld walking cane and the underarm crutch. The handheld walking cane comprises a handle formed at an upper end thereof to provide a handhold for the user. When the walking cane is used, the user can hold the handle to compress a bottom tip of the walking cane against the floor, resulting in help stabilizing the user's standing or walking. On the other hand, the underarm crutch has an arc-shaped pad formed at an upper end thereof, so that the user can place his/her armpit against the arc-shaped pad. Also, a bottom tip formed at a lower end of the underarm crutch is configured to bear against the floor to achieve a support effect. Moreover, each of the two kinds of walking sticks has a rubber pad disposed on the bottom tip thereof to provide a buffering and shock-absorbing effect and to reduce the friction when the rubber makes contact with the floor, achieving a non-slip effect.

However, the conventional base structure for a walking stick is disadvantageous because: (i) because of the limitation in the thickness and shape of the rubber pad, the conventional base structure can only provide a limited swing amplitude and shock absorbing ability, which lowers the maneuverability of the walking stick; (ii) due to elastic fatigue, the rubber pad disposed on the conventional walking stick is easy to be damaged after a period of use, so that the rubber pad needs to be inspected and replaced frequently; and (iii) the conventional base structure for a walking stick is a kind of fixing structure which cannot be swung when it makes contact with the floor. Thus, the walking stick may be unable to stabilize a user when walking or climbing on tilted grounds, resulting in lowering the reliability and safety. Therefore, there remains a need for a new and improved design for a base structure for walking stick to overcome the problems presented above.

SUMMARY OF THE INVENTION

The present invention provides a base structure for a walking stick, which is configured to dispose in a bottom end of a stick body of the walking stick to provide a buffering and shock-absorbing effect. The base structure comprises a main body, a shaft, a first sleeve, and a second sleeve. A central upper end of the main body has a concave slot, and a receiving space connected to a lower end of the concave slot is formed inside the main body. An upper portion and a lower portion of the shaft respectively have a first connecting portion and a second connecting portion, and a locating flange is formed between the first connecting portion and the second connecting portion. The second connecting portion of the shaft is inserted through the first sleeve and the concave slot into the receiving space of the main body, and an elastic unit disposed on the second connecting portion is located inside the receiving space. Because of the resilience of the elastic unit, the shaft can be compressed downwardly to bear the locating flange against an inner lower end of the first sleeve, and an outer lower end of the first sleeve is borne against the main body simultaneously. A buffering unit is disposed on the first connecting portion, and a first end of the buffering unit is borne against the locating flange while a second end thereof sticks out from the first sleeve. A bottom end of the first sleeve has a protruding portion which is driven by the shaft to downwardly bear against the concave slot of the main body. The second sleeve comprises a sleeve body, a first tightening ring and a second tightening ring, and a blocking piece is formed inside a central portion of the sleeve body. The sleeve body has an upper receiving portion and a lower receiving portion respectively located at an upper portion and a lower portion thereof, and the blocking piece is located between the upper receiving portion and the lower receiving portion. Furthermore, the lower receiving portion covers around the first sleeve, and the blocking piece is borne against the buffering unit. A hollow tube formed at an upper end of the blocking piece is configured to receive and secure the shaft. Moreover, a threaded section formed at an outer periphery of the upper receiving portion is configured to connect with the first tightening ring, and the first tightening ring is further connected with the second tightening ring to achieve better tightening effect.

Comparing with conventional base structure for a walking stick, the present invention is advantageous because: the base structure can provide a better buffering and shock-absorbing effect and allow the stick body to swing in all direction. Also, the buffering unit can allow the second sleeve to be compressed and stretched. Thus, the walking stick can achieve the stretch motion stably, and buffer the reactive force from the floor. Moreover, because of the connected structure between the main body and the first sleeve, the stick body with the first sleeve can swing in all direction along the concave slot when the main body makes contact with the floor, resulting in the main body being able to stably stand on different tilted floors. In conclusion, the base structure for a walking stick in the present invention can be smoothly used to stand on different tilted grounds, and also can improve the reliability and safety of the walking stick.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
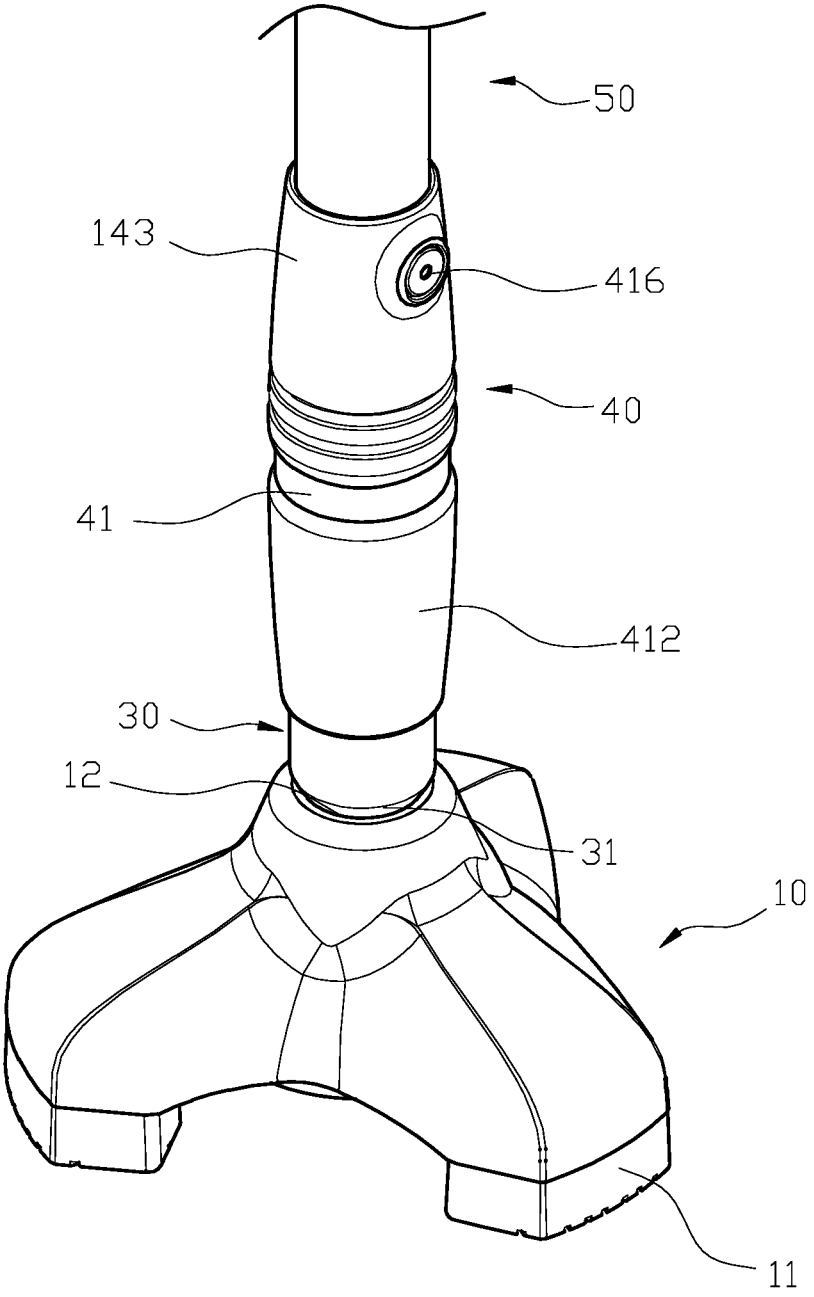
FIG. 1 is a three-dimensional view of a base structure for a walking stick in the present invention.
Figure 2:
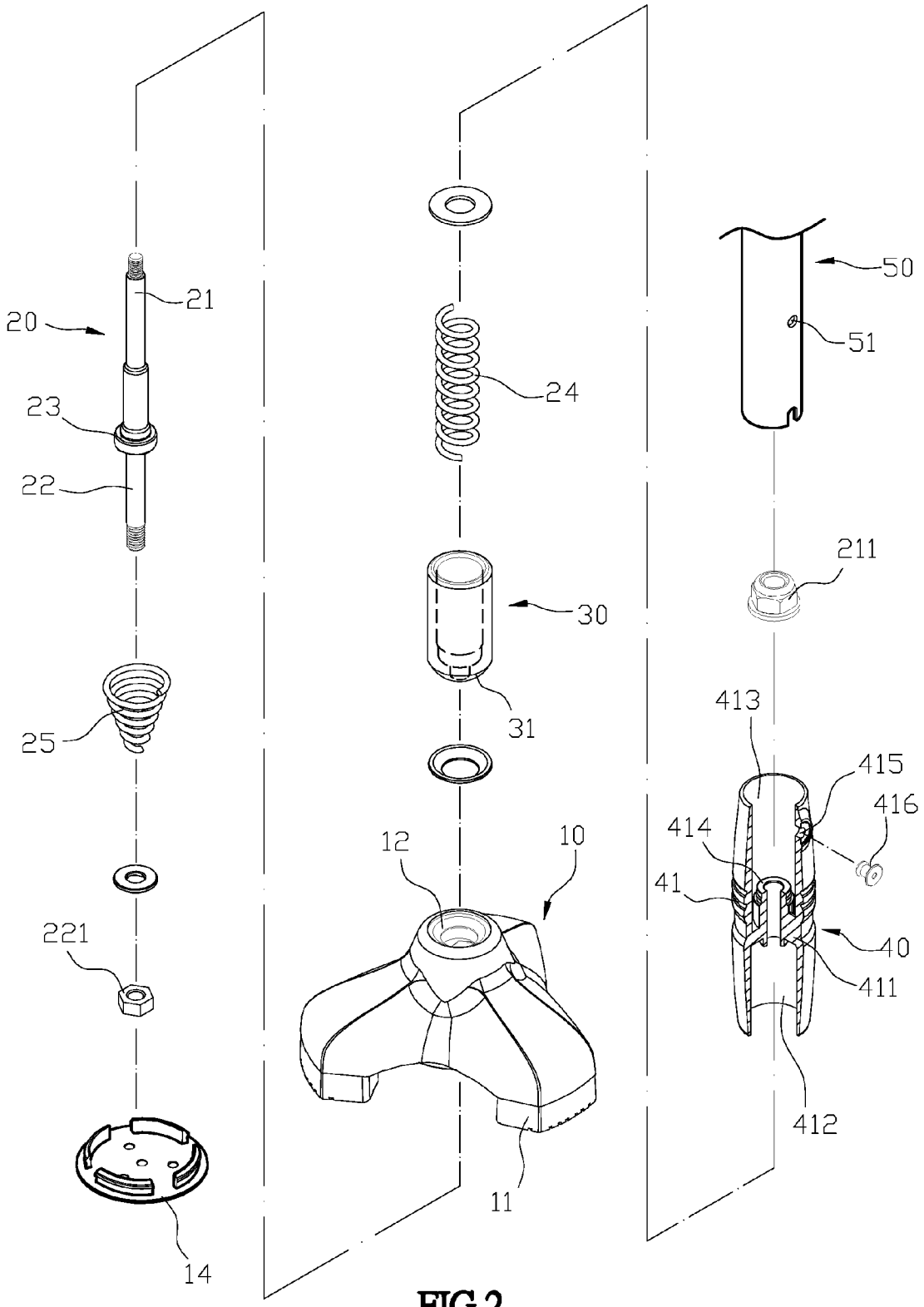
FIG. 2 is an exploded view of the base structure for a walking stick in the present invention.
Figure 3:
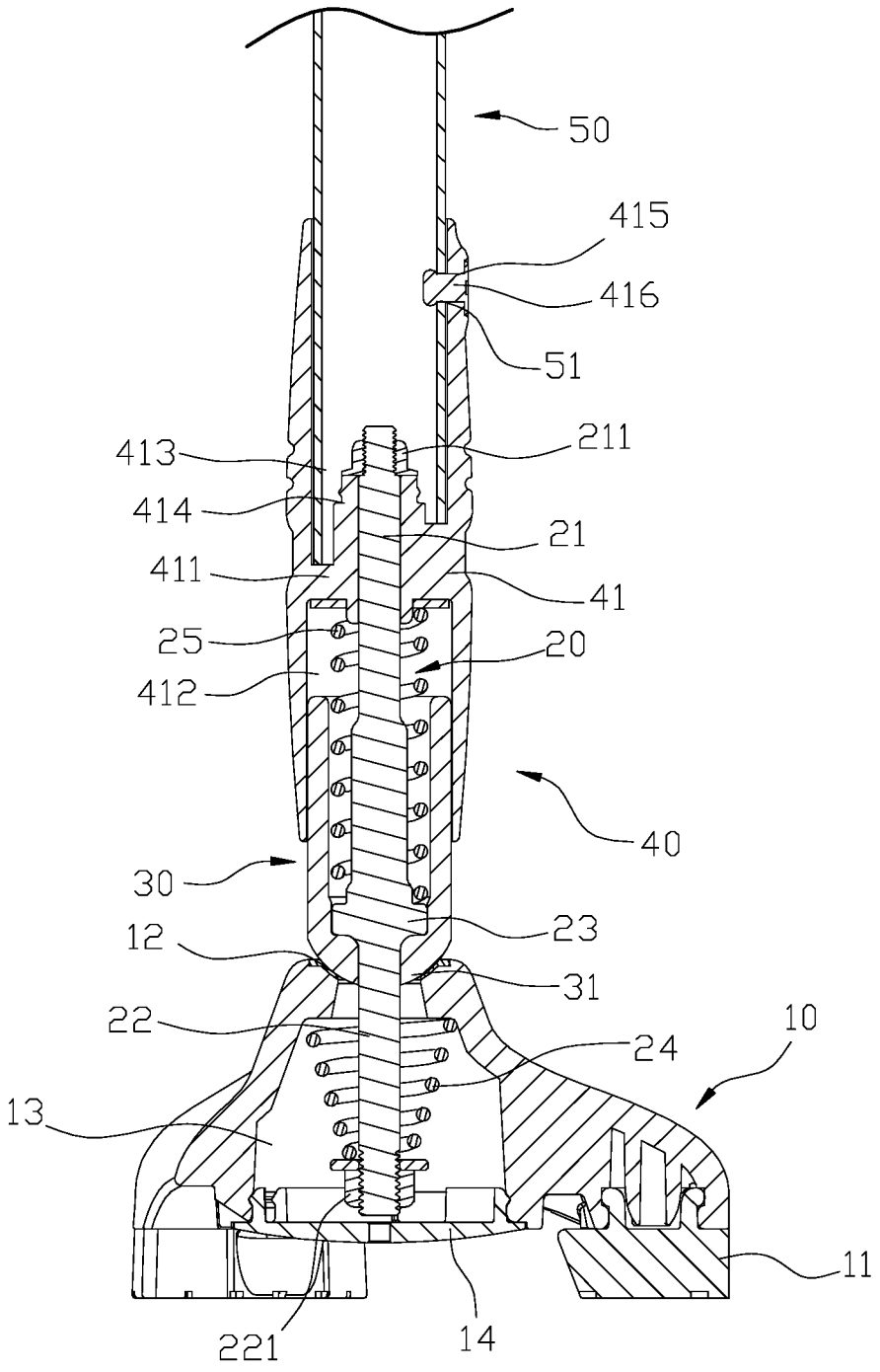
FIG. 3 is a sectional view of the base structure for a walking stick in the present invention.

In order to further understand the goal, characteristics and effect of the present invention, a number of embodiments along with the drawings are illustrated as following:

Referring to FIGS. 1 to 3, the present invention provides a base structure for a walking stick, which is configured to dispose in a bottom end of a stick body (50) of the walking stick to provide a buffering and shock-absorbing effect. The base structure comprises a main body (10), a shaft (20), a first sleeve (30), and a second sleeve (40). The main body (10) is formed in a tripod shape, and each of three bottom ends of the main body (10) has a rubber tip (11). A central upper end of the main body (10) has a concave slot (12), and a receiving space (13) connected to a lower end of the concave slot (12) is formed inside the main body (10). A bottom portion of the main body (10) connected to a lower end of the receiving space (13) has a cover (14) to provide a blocking effect. An upper portion and a lower portion of the shaft (20) respectively have a first connecting portion (21) and a second connecting portion (22), and a locating flange (23) is formed between the first connecting portion (21) and the second connecting portion (22). The second connecting portion (22) of the shaft (20) is inserted through the first sleeve (30) and the concave slot (12) into the receiving space (13) of the main body (10), and an elastic unit (25) disposed on the second connecting portion (22) is located inside the receiving space (13). Because of the resilience of the elastic unit (25), the shaft (20) can be compressed downwardly to bear the locating flange (23) against an inner lower end of the first sleeve (30), and an outer lower end of the first sleeve (30) is borne against the main body (10) simultaneously. A buffering unit (24) is disposed on the first connecting portion (21), and a first end of the buffering unit (24) is borne against the locating flange (23) while a second end thereof sticks out from the first sleeve (30). A bottom end of the first sleeve (30) has a protruding portion (31) which is driven by the shaft (20) to downwardly bear against the concave slot (12) of the main body (10). The second sleeve (40) comprises a sleeve body (41), and a blocking piece (411) is formed inside a central portion of the sleeve body (41). The sleeve body (41) has an upper receiving portion (413) and a lower receiving portion (412) respectively located at an upper portion and a lower portion thereof, and the blocking piece (411) is located between the upper receiving portion (413) and the lower receiving portion (412). Furthermore, the lower receiving portion (412) covers around the first sleeve (30), and the blocking piece (411) is borne against the buffering unit (24). A hollow tube (414) formed at an upper end of the blocking piece (411) is configured to receive and secure the shaft (20). The stick body (50) is inserted into the upper receiving portion (413), and a lateral wall of the upper receiving portion (413) of the sleeve body (41) comprises a first through hole (415). Moreover, a second through hole (51) formed at a lateral wall of the stick body (50) is aligned with the first through hole (415), and a bolt (416) is inserted through the first through hole (415) and the second through hole (51) to complete the connection between the sleeve body (41) and the stick body (50).

Referring to FIGS. 1 to 3, the second connecting portion (22) of the shaft (20) is inserted through the first sleeve (30) and the concave slot (12) into the receiving space (13) of the main body (10). The elastic unit (25) disposed on the second connecting portion (22) is located inside the receiving space (13), and a second nut (221) fastened on a lower end of the second connecting portion (22) is configured to limit the position of the elastic unit (25). Because of the resilience of the elastic unit (25), the shaft (20) can be compressed downwardly to achieve a buffering and shock-absorbing effect. Simultaneously, the first sleeve (30) driven by the locating flange (23) is moved downwardly, so that the protruding portion (31) of the first sleeve (30) is borne against the concave slot (12) of the main body (10). As a result, the connected structure between the main body (10) and the first sleeve (30) can allow the walking stick to achieve the swing motion in all direction. Also, the buffering unit (24) is disposed on the first connecting portion (21) of the shaft (20), and the shaft (20) with the buffering unit (24) is inserted into a lower portion of the second sleeve (40). Moreover, the lower receiving portion (412) of the sleeve body (41) of the second sleeve (40) covers around an upper portion of the first sleeve (30), and two ends of the buffering unit (24) are respectively borne against the blocking piece (411) and the locating flange (23). Furthermore, the first connecting portion (21) of the shaft (20) is inserted through the hollow tube (414), and a first nut (211) is fastened on an upper end of the first connecting portion (21) of the shaft (20). The stick body (50) is connected to the upper receiving portion (413) of the second sleeve (40), and the bolt (416) is inserted through the first through hole (415) on the upper receiving portion (413) and the second through hole (51) of the stick body (50) to complete the connection between the sleeve body (41) and the stick body (50).

Figure 4:
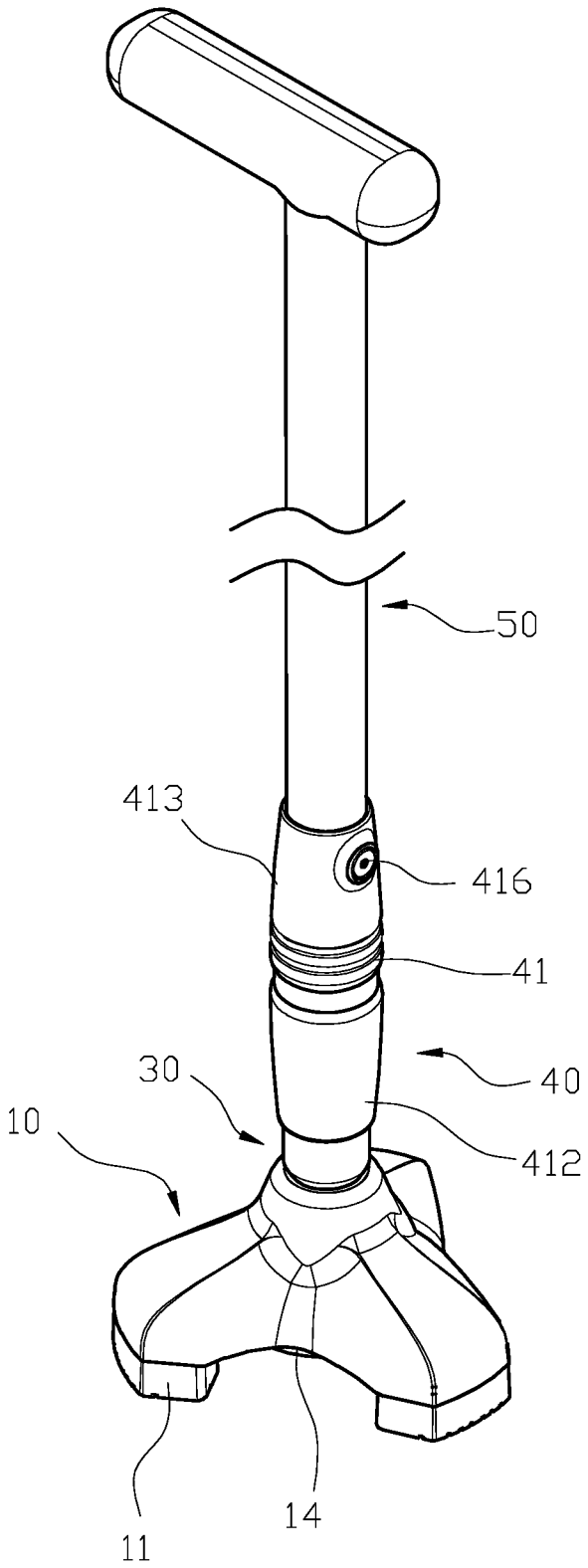
FIG. 4 is a schematic view of the walking stick in the present invention.
Figure 5:
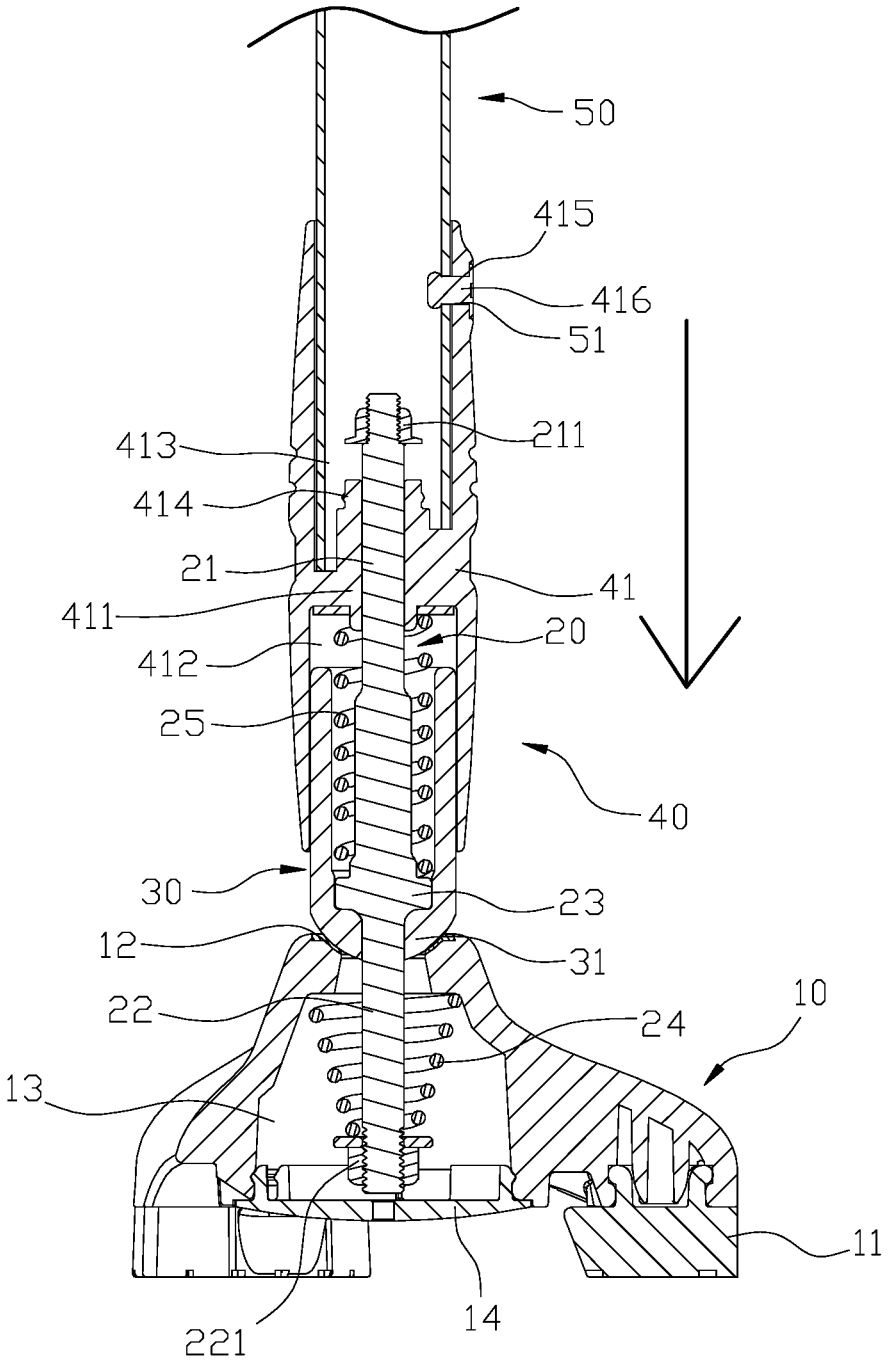
FIG. 5 is a schematic view of the base structure for a walking stick in the present invention when the walking stick is compressed downwardly.

In actual application, referring to FIGS. 3 to 5, when a user holds the walking stick against the floor, the force exerted by the user is downwardly transferred though the second sleeve (40) to compress the buffering unit (24). Thus, the structure between the second sleeve (40) and the first sleeve (30) in the present invention can provide a buffering and shock-absorbing effect and reduce the reactive force from the floor. As a result, the base structure can provide a comfortable way of use. Moreover, when the walking stick is moved to leave from the floor, the buffering unit (24) and the second sleeve (40) will return to their uncompressed positions respectively.

Figure 6:
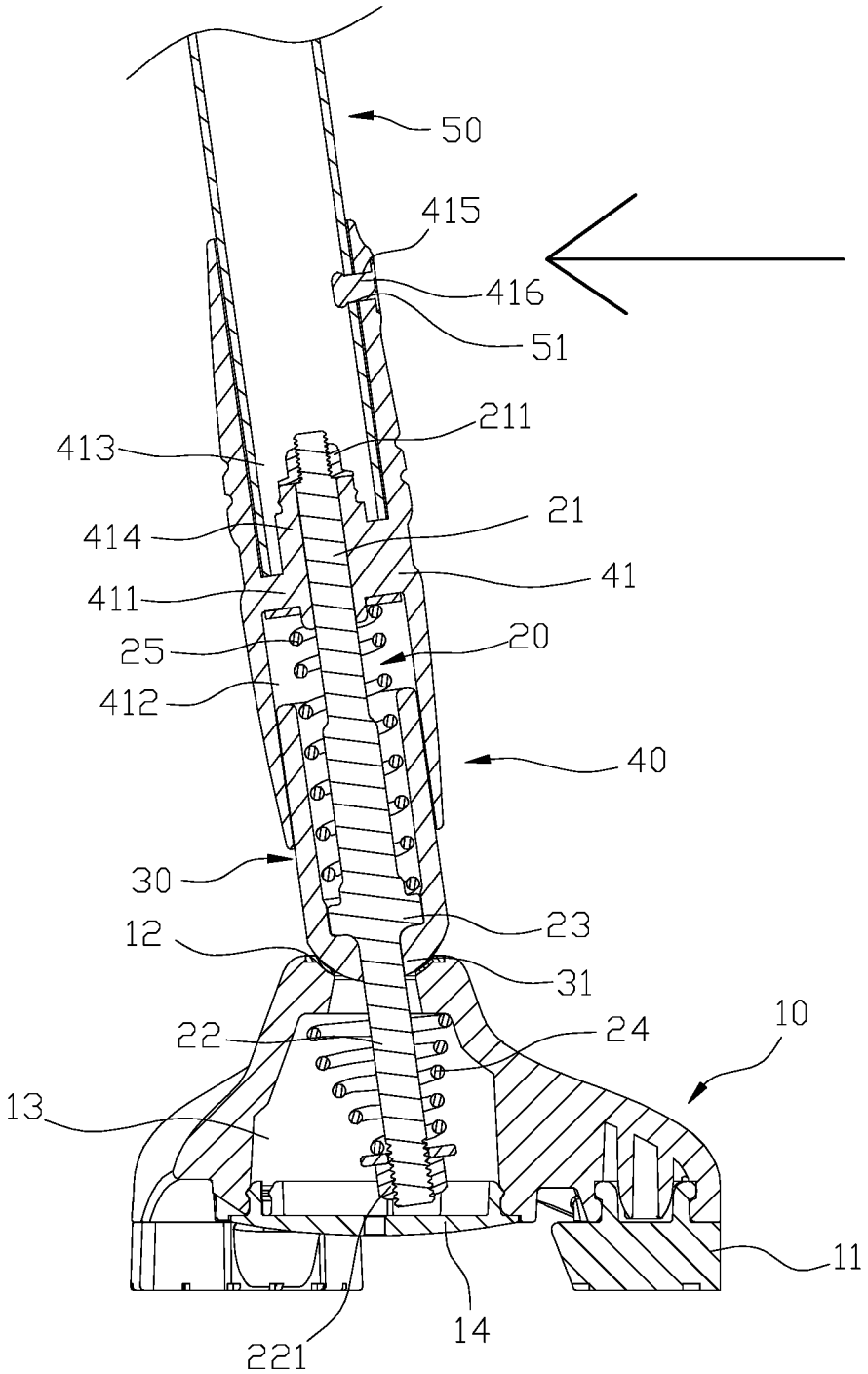
FIG. 6 is a schematic view of the base structure for a walking stick in the present invention when the walking stick is compressed by a side force from a first direction to tilt with an angle.
Figure 7:
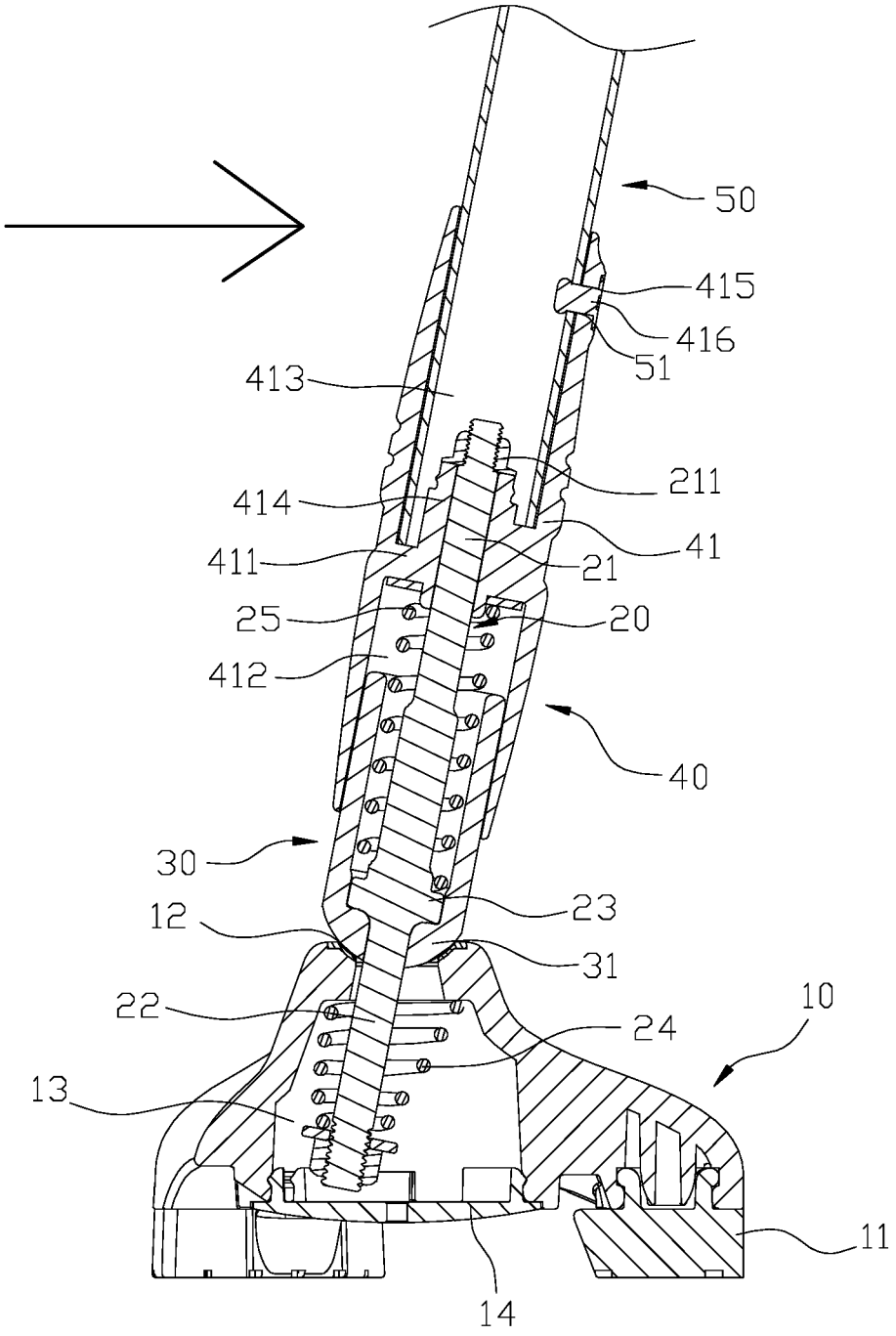
FIG. 7 is a schematic view of the base structure for a walking stick in the present invention when the walking stick is compressed by a side force from a second direction to tilt with an angle.

Referring to FIGS. 6 and 7, the protruding portion (31) of the first sleeve (30) is sunk and borne against the concave slot (12) of the main body (10), so that the connected structure between the first sleeve (30) and the main body (10) can allow the walking stick to achieve the swing motion in all direction. The second connecting portion (22) of the shaft (20) inserted through the first sleeve (30), the main body (10) and the elastic unit (25) is secured inside the receiving space (13) of the main body (10). When a user uses the walking stick to walk on the tilted ground, both the main body (10) and the stick body (50) might receive the side force. At the moment, the connected structure between the main body (10) and the first sleeve (30) can allow the walking stick to achieve the swing motion in all direction, so that the base structure of the present invention can provide better stability and safety when the walking stick makes contact with the floor. Moreover, the elastic unit (25) can provide a buffering and shock-absorbing effect to reduce the reactive force generated between the main body (10) and the first sleeve (30). Also, when the main body (10) is moved to leave from the floor, the elastic unit (25) will return to its original position due to the resilience, and the stick body (50) will straightly stand on the main body (10).

Figure 8:
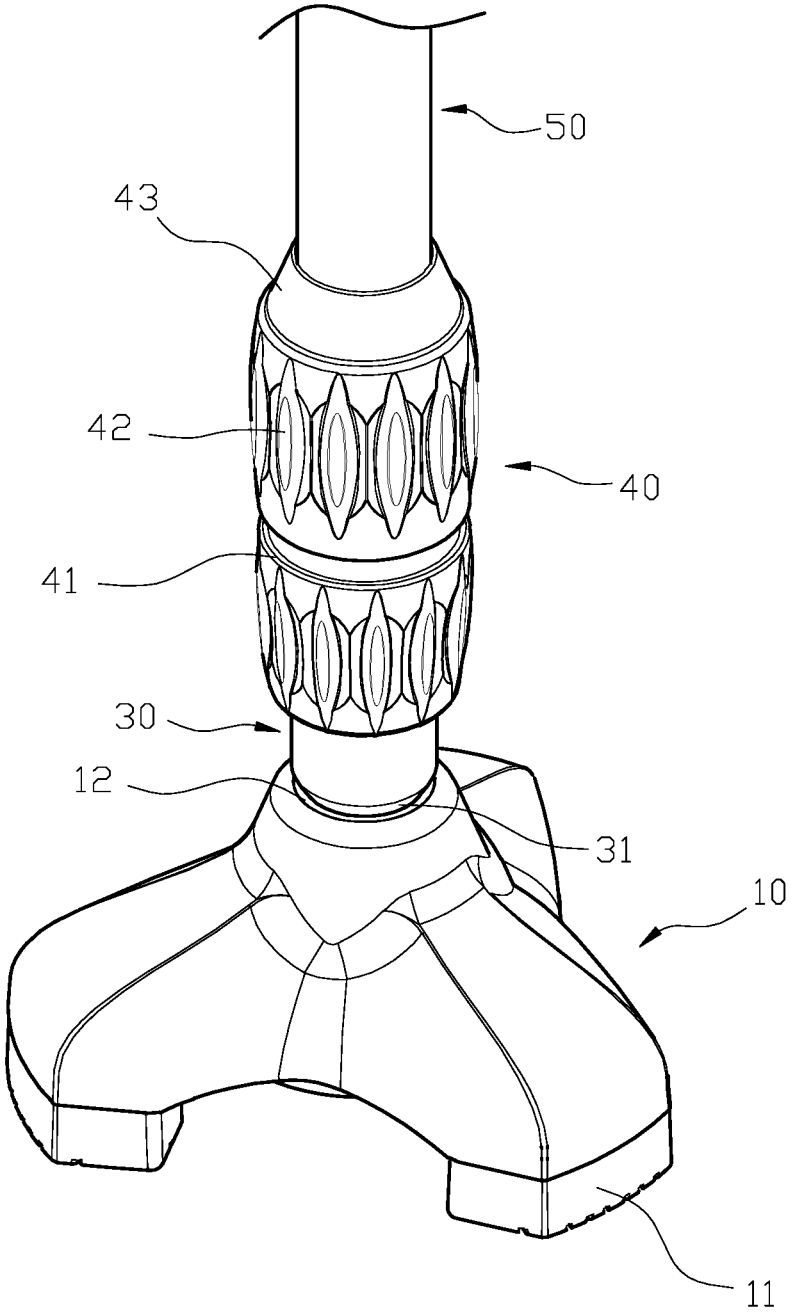
FIG. 8 is a three-dimensional view of another embodiment of the base structure for a walking stick in the present invention.
Figure 9:
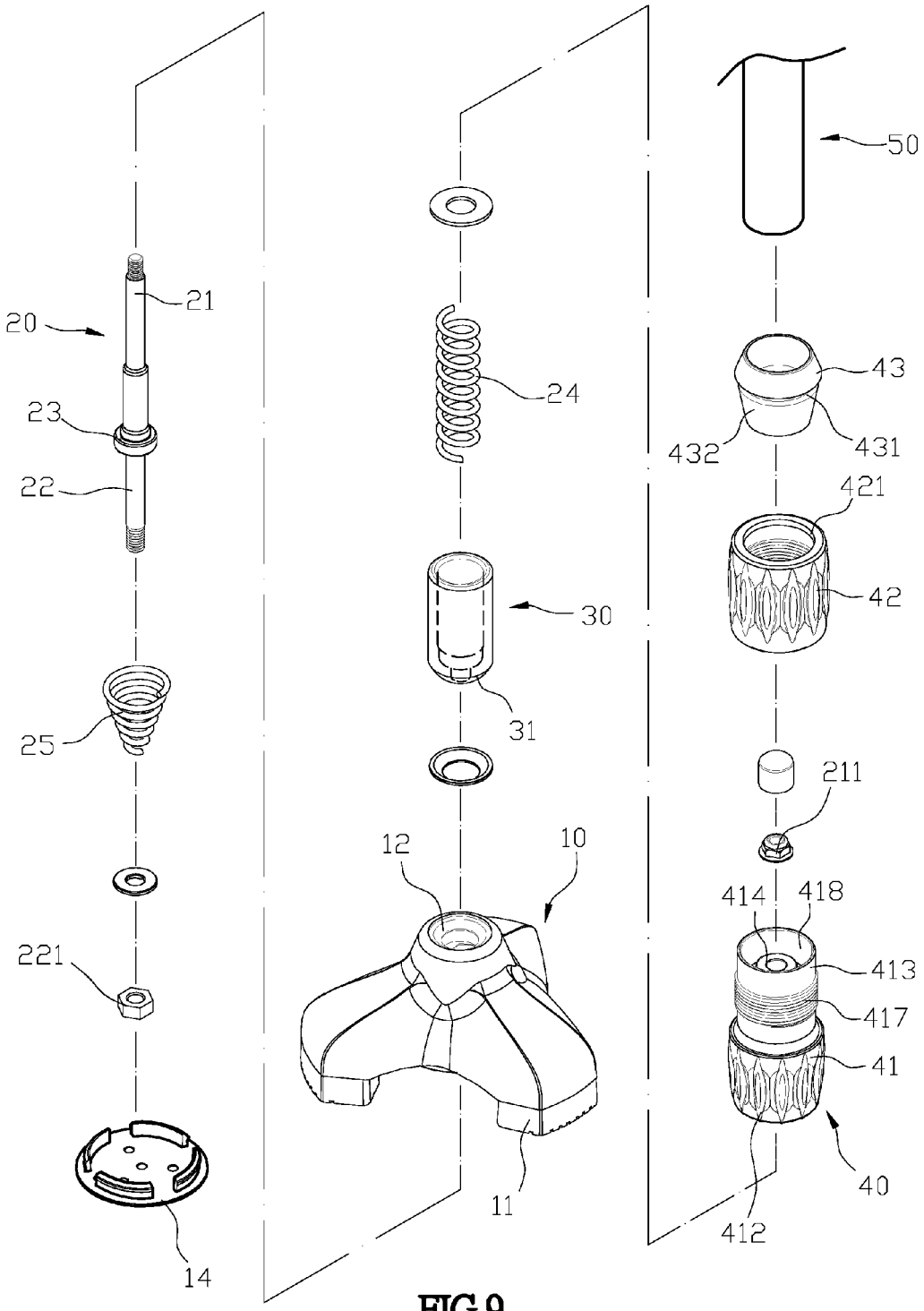
FIG. 9 is an exploded view of another embodiment of the base structure for a walking stick in the present invention.
Figure 10:
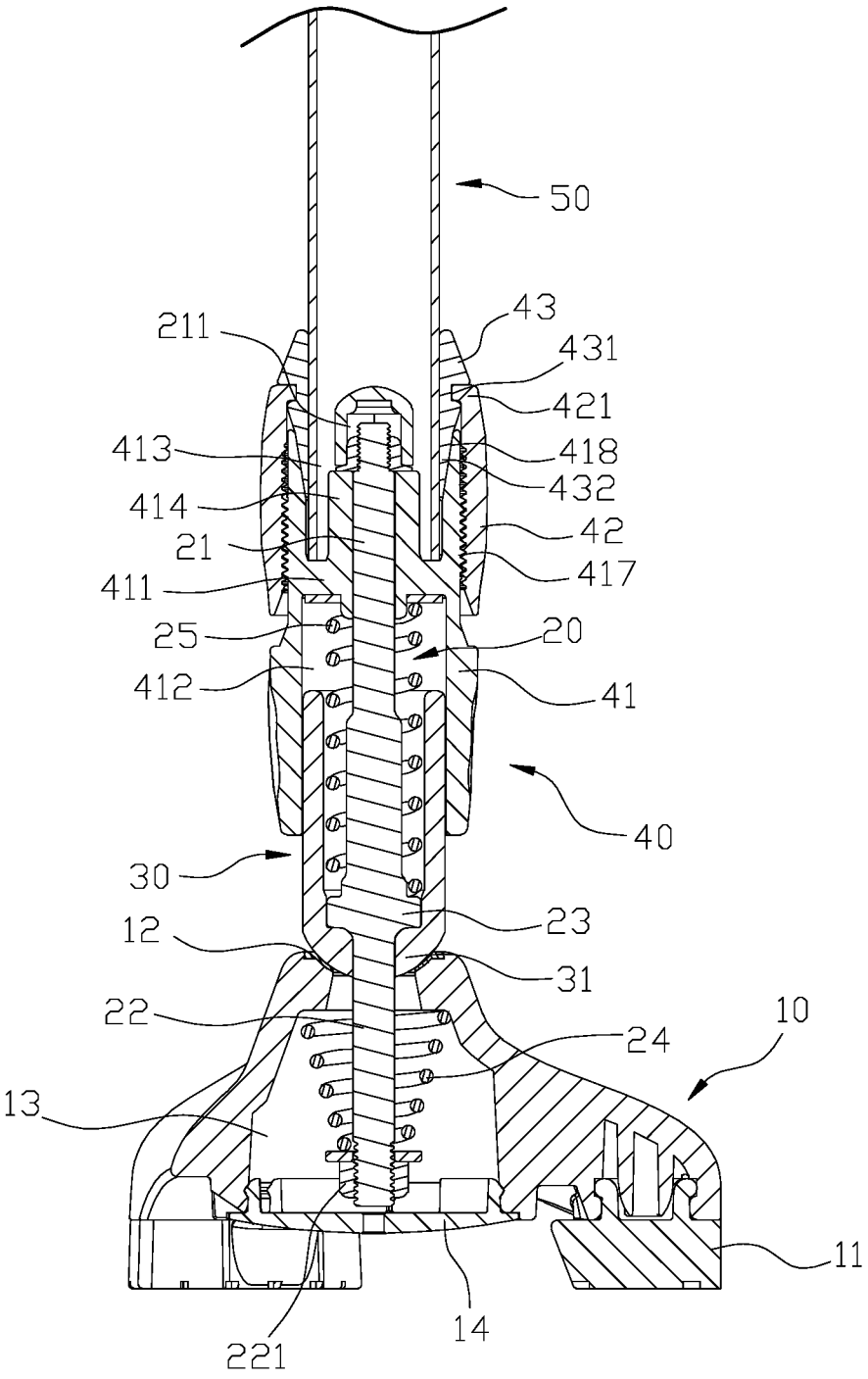
FIG. 10 is a sectional view of another embodiment of the base structure for a walking stick in the present invention.

In another embodiment, referring to FIGS. 8 and 9, a threaded section (417) is formed at an outer periphery of the upper receiving portion (413) of the second sleeve (40), and an inner surface of the upper receiving portion (413) has a tapered opening (418). Furthermore, the second sleeve (40) is connected to a first tightening ring (42) and a second tightening ring (43). An open end of the first tightening ring (42) has an engaging portion (421), and an outer wall of the second tightening ring (43) comprises an annular groove (431) and a tapered surface (432). Thus, when the engaging portion (421) is engaged with the annular groove (431), the first tightening ring (42) and the second tightening ring (43) can be moved simultaneously. Furthermore, when the first tightening ring (42) is engaged with the sleeve body (41), the tapered surface (432) of the second tightening ring (43) is moved inwardly along the tapered opening (418). Thus, the first tightening ring (42) with the second tightening ring (43) is connected to the upper receiving portion (413) of the second sleeve (40).

In actual installation process, referring to FIGS. 5, 8, 9 and 10, the base structure is connected to the stick body (50) through the upper receiving portion (413) of the second sleeve (40). In the connection process, firstly, the first tightening ring (42) is loosened, and thus the stick body (50) can be inserted through the second tightening ring (43) into the upper receiving portion (413) of the sleeve body (41). Then the first tightening ring (42) is tightened to drive the tapered surface (432) of the second tightening ring (43) to be moved inwardly along the tapered opening (418), so that the second tightening ring (43) can be secured around an outer periphery of the stick body (50).

Comparing with conventional base structure for a walking stick, the present invention is advantageous because: the base structure can provide a better buffering and shock-absorbing effect and allow the stick body (50) to swing in all direction. Also, the buffering unit (24) can allow the second sleeve (40) to be compressed and stretched. Thus, the walking stick can achieve the stretch motion stably, and buffer the reactive force from the floor. Moreover, because of the connected structure between the main body (10) and the first sleeve (30), the stick body (50) with the first sleeve (30) can swing in all direction along the concave slot (12) when the main body (10) makes contact with the floor, resulting in the main body (10) being able to stably stand on different tilted floors. In conclusion, the base structure for a walking stick in the present invention can be smoothly used to stand on different tilted grounds, and also can improve the reliability and safety of the walking stick.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A base structure for a walking stick, which is configured to dispose in a bottom end of a stick body of the walking stick to provide a buffering and shock-absorbing effect, comprising:

a main body having a concave slot formed at a central upper end thereof, and a receiving space, which is connected to a lower end of the concave slot, formed inside the main body;

a shaft comprising a first connecting portion and a second connecting portion respectively formed at an upper portion and a lower portion of the shaft, and a locating flange formed between the first connecting portion and the second connecting portion, the second connecting portion inserted through a first sleeve and the concave slot into the receiving space of the main body, and an elastic unit, which is disposed on the second connecting portion, located inside the receiving space, because of the resilience of the elastic unit, the shaft being able to be compressed downwardly to bear the locating flange against an inner lower end of the first sleeve, and an outer lower end of the first sleeve borne against the main body simultaneously, a buffering unit disposed on the first connecting portion, and a first end of the buffering unit borne against the locating flange while a second end thereof sticking out from the first sleeve;

the first sleeve having a protruding portion formed at a bottom end thereof, and driven by the shaft to downwardly bear against the concave slot of the main body; and a second sleeve comprising a sleeve body having an upper receiving portion and a lower receiving portion respectively located at an upper portion and a lower portion thereof, and a blocking piece located between the upper receiving portion and the lower receiving portion, the lower receiving portion covering around the first sleeve, and the blocking piece borne against the buffering unit, also, a hollow tube, which is formed at an upper end of the blocking piece, configured to receive and secure the shaft.

2. The base structure for a walking stick of claim 1, wherein the main body is formed in a tripod shape, and each of three bottom ends of the main body has a rubber tip.

3. The base structure for a walking stick of claim 1, wherein a bottom portion of the main body is connected to a lower end of the receiving space, and has a cover to provide a blocking effect.

4. The base structure for a walking stick of claim 1, wherein a first through hole and a second through hole, which are respectively formed at a lateral wall of the upper receiving portion of the sleeve body and a lateral wall of the stick body, are aligned with each other, and a bolt is inserted through the first through hole and the second through hole to complete the connection between the sleeve body and the stick body.

5. The base structure for a walking stick of claim 1, a threaded section formed at an outer periphery of the upper receiving portion is configured to connect with a first tightening ring, and the first tightening ring is further connected with a second tightening ring to achieve better tightening effect.

6. The base structure for a walking stick of claim 5, wherein an inner surface of the upper receiving portion of the sleeve body comprises a tapered opening, and an outer wall of the second tightening ring has a tapered surface, wherein when the first tightening ring is connected to the sleeve body, the tapered surface of the second tightening ring driven by the first tightening ring is sunk and borne against the tapered opening into an inner space of the upper receiving portion, achieving the tightening effect.

7. The base structure for a walking stick of claim 5, wherein the outer wall of the second tightening ring comprises an annular groove, and an engaging portion formed at an open end of the first tightening ring is configured to connect to the annular groove for achieving the connection between the first tightening ring and the second tightening ring.

* * * * *